US010202760B1

(12) United States Patent
Miller

(10) Patent No.: US 10,202,760 B1
(45) Date of Patent: Feb. 12, 2019

(54) SELF-ALIGNING, DOUBLE WIRE CORNER BEAD FOR FIREPROOFING STRUCTURAL STEEL MEMBER AND METHOD OF USING SAME

(71) Applicant: Philip Glen Miller, Lake Charles, LA (US)

(72) Inventor: Philip Glen Miller, Lake Charles, LA (US)

( * ) Notice: Subject to any disclaimer, the term of this patent is extended or adjusted under 35 U.S.C. 154(b) by 0 days.

(21) Appl. No.: 16/100,521

(22) Filed: Aug. 10, 2018

Related U.S. Application Data

(60) Division of application No. 15/382,690, filed on Dec. 18, 2016, now Pat. No. 10,060,123, which is a division of application No. 14/832,074, filed on Aug. 21, 2015, now Pat. No. 9,540,813, which is a continuation-in-part of application No. 14/292,881, filed on May 31, 2014, now Pat. No. 9,140,005.

(60) Provisional application No. 62/040,182, filed on Aug. 21, 2014, provisional application No. 61/830,257, filed on Jun. 3, 2013.

(51) Int. Cl.

| | |
|---|---|
| ***E04B 1/94*** | (2006.01) |
| ***E04F 13/04*** | (2006.01) |
| ***E04C 3/06*** | (2006.01) |
| ***E04C 3/293*** | (2006.01) |
| *E04F 13/06* | (2006.01) |
| *E04C 3/04* | (2006.01) |

(52) U.S. Cl.
CPC ..... *E04B 1/944* (2013.01); *E04C 3/06* (2013.01); *E04C 3/293* (2013.01); *E04C 2003/0452* (2013.01); *E04F 13/047* (2013.01); *E04F 13/068* (2013.01); *Y10T 428/1241* (2015.01)

(58) Field of Classification Search
CPC . E04B 1/944; E04C 3/293; E04C 3/06; E04C 2003/0452; E04F 13/047; E04F 13/068; Y10T 428/1241
USPC ..... 52/834, 741.41
See application file for complete search history.

(56) References Cited

U.S. PATENT DOCUMENTS

| | | | |
|---|---|---|---|
| D131,506 | S | 9/1872 | Corbett |
| RE5,179 | E | 12/1872 | Corbett |
| 583,413 | A | 5/1897 | Meserve |

(Continued)

FOREIGN PATENT DOCUMENTS

| | | |
|---|---|---|
| WO | 2012105858 | 8/2012 |

OTHER PUBLICATIONS

Stockton Wire Products, "Plastic Nose Weep-Aid® for better construction", Pages from brochure, printed 1989, 3 pages.

*Primary Examiner* — Brent W Herring
(74) *Attorney, Agent, or Firm* — Katarzyna Brozynski; Antonio Devora

(57) ABSTRACT

A self-aligning, double wire corner bead for fireproofing structural steel along a plurality of surfaces, the corner bead having a single strip of welded wire fabric cut to a predetermined width for the fireproofing thickness and bent along a plurality of longitudinally extending lines, to provide a profile having a plurality of dihedral angles is disclosed. A nose is installed along two edges. A method of finishing the corners for fireproofing of structural steel member using an improved corner bead includes the step of attaching the corner bead through a lath to the structural steel member utilizing fasteners. The mesh of the corner bead provides a dam to form a roughened surface on the first application of fireproofing material until it hardens.

11 Claims, 5 Drawing Sheets

(56) References Cited

U.S. PATENT DOCUMENTS

| | | | | |
|---|---|---|---|---|
| 624,076 | A | | 5/1899 | Parker |
| 632,007 | A | | 8/1899 | Broome |
| 640,409 | A | | 1/1900 | Parker |
| 658,386 | A | | 9/1900 | Mitchell |
| 1,110,369 | A | | 9/1914 | Bagnall et al. |
| 1,122,076 | A | | 12/1914 | Collins |
| 1,210,560 | A | | 1/1917 | Tappen |
| 1,419,232 | A | | 6/1922 | Curtis |
| 1,608,475 | A | | 11/1926 | Dean |
| 1,624,121 | A | | 4/1927 | Thiem |
| 1,782,147 | A | | 11/1930 | Merryweather |
| 1,858,836 | A | | 5/1932 | Martell |
| 1,907,990 | A | | 5/1933 | Manske |
| 1,983,994 | A | * | 12/1934 | Raynor ..... E04F 13/04 52/454 |
| 1,988,081 | A | | 1/1935 | Kemper |
| 2,005,572 | A | | 6/1935 | Vass |
| 2,012,203 | A | | 8/1935 | Peterson |
| 2,061,050 | A | | 11/1936 | Stafford |
| 2,074,463 | A | | 3/1937 | Davis |
| 2,127,806 | A | | 8/1938 | Burt |
| 2,196,086 | A | | 4/1940 | Sprouse |
| 2,213,603 | A | | 9/1940 | Young et al. |
| 2,267,002 | A | | 12/1941 | Turner |
| 2,370,052 | A | | 2/1945 | Lindelow |
| 2,391,581 | A | | 12/1945 | Markuson |
| 2,465,756 | A | | 3/1949 | Schepis |
| 2,483,888 | A | | 10/1949 | Danielson |
| 2,702,932 | A | | 3/1955 | Woodson |
| 2,945,329 | A | | 7/1960 | Schneller |
| 2,969,616 | A | | 1/1961 | Gustafson |
| 3,175,330 | A | | 3/1965 | Holson |
| 3,217,456 | A | | 11/1965 | Quigg |
| 3,255,561 | A | | 6/1966 | Cable |
| 3,295,268 | A | | 1/1967 | Alva |
| 3,345,788 | A | | 10/1967 | Holsman |
| 3,412,512 | A | | 11/1968 | Hollister |
| 3,516,213 | A | | 6/1970 | Sauer |
| 3,748,815 | A | | 7/1973 | Parker |
| 3,772,844 | A | | 11/1973 | Thome |
| 3,908,327 | A | | 9/1975 | Quigg |
| 3,913,290 | A | | 10/1975 | Billing et al. |
| 4,043,092 | A | | 8/1977 | Paul et al. |
| 4,069,075 | A | | 1/1978 | Billing et al. |
| 4,391,074 | A | | 7/1983 | Holsman |
| 4,493,945 | A | | 1/1985 | Feldman |
| 4,683,019 | A | | 7/1987 | Motoki |
| 4,729,916 | A | | 3/1988 | Feldman |
| 4,854,107 | A | | 8/1989 | Roberts |
| 4,955,173 | A | | 9/1990 | Czechowski |
| 5,073,430 | A | | 12/1991 | Aidan |
| 5,157,887 | A | | 10/1992 | Watterworth, III et al. |
| 5,398,472 | A | | 3/1995 | Eichelkraut |
| 5,433,991 | A | | 7/1995 | Boyd |
| 5,580,648 | A | | 12/1996 | Castle et al. |
| 5,625,986 | A | | 5/1997 | Mansfield et al. |
| 5,685,116 | A | | 11/1997 | Bradshaw et al. |
| 5,788,403 | A | | 8/1998 | Dison et al. |
| 6,330,777 | B1 | | 12/2001 | Padley |
| 6,591,566 | B1 | | 7/2003 | Rodlin |
| 6,698,144 | B1 | | 3/2004 | Larson |
| 7,921,537 | B2 | | 4/2011 | Rodlin |
| 8,291,676 | B2 | | 10/2012 | Hong et al. |
| 8,555,593 | B2 | | 10/2013 | Ramos |
| 9,140,005 | B2 | | 9/2015 | Miller |
| 9,540,813 | B2 | | 1/2017 | Miller |
| 10,060,123 | B2 | | 8/2018 | Miller |
| 10,087,622 | B2 | | 10/2018 | Miller |
| 2002/0005023 | A1 | | 1/2002 | Ford |
| 2003/0024188 | A1 | | 2/2003 | Smythe |
| 2003/0079429 | A1 | | 5/2003 | Rodlin |
| 2004/0250488 | A1 | | 12/2004 | Rodlin |
| 2007/0119106 | A1 | | 5/2007 | Sacks et al. |
| 2008/0282644 | A1 | | 11/2008 | Hong et al. |
| 2012/0085047 | A1 | | 4/2012 | Hiscock |
| 2012/0110936 | A1 | | 5/2012 | Egan et al. |
| 2013/0205696 | A1 | | 8/2013 | Little et al. |
| 2014/0352243 | A1 | | 12/2014 | Miller |
| 2016/0040428 | A1 | | 2/2016 | Miller |

* cited by examiner

SELF-ALIGNING, DOUBLE WIRE CORNER BEAD FOR FIREPROOFING STRUCTURAL STEEL MEMBER AND METHOD OF USING SAME

CROSS-REFERENCE TO RELATED APPLICATIONS

This application is a divisional application of U.S. application Ser. No. 15/382,690, filed on Dec. 18, 2016, which is a divisional application of U.S. application Ser. No. 14/832,074, filed Aug. 21, 2015, now U.S. Pat. No. 9,540,813, issued Jan. 10, 2017, which claims priority to U.S. Provisional Application No. 62/040,182, filed Aug. 21, 2014. U.S. application Ser. No. 14/832,074 is also a continuation-in-part of U.S. application Ser. No. 14/292,881, filed May 31, 2014, now U.S. Pat. No. 9,140,005, issued Sep. 22, 2015, which claims priority to U.S. Provisional Application No. 61/830,257, filed Jun. 3, 2013. Each of the above patent applications is incorporated herein by reference in its entirety to provide continuity of disclosure.

TECHNICAL FIELD

The present invention relates generally to a corner bead for cementitious fireproofing of structural steel members and, more particularly, to a device that is self-aligning in installation and allows the accurate gauging of the thickness of the fireproofing material along three surfaces.

BACKGROUND OF THE INVENTION

In the art of a corner bead for fireproofing structural steel, prior approaches conventionally include a v-bend corner bead having adjustable legs (flanges). This type of corner bead is mostly used in the plastering and stucco trades. The previously utilized corner bead is constructed of wires welded into a lattice that is v-shaped in section as shown in FIG. 1.

In installation, the longitudinal base wires of the v-shaped corner bead are attached with a tie wire either onto a metal lath or onto a wire mesh, and further attached to the steel member to be fireproofed as shown in FIG. 2. At best, this allows for distribution of the fireproofing material along two surfaces after a complex negotiation of the correct height of the two flanges; to wit, to establish the correct fireproofing thickness, one must establish the correct height of the vertex by shrinking or expanding the distance between the legs (flanges) of the corner bead defined by the vertex. Using this technique, the alignment of the corner bead with the adjacent surface is difficult and great skill is required to install the corner bead for fireproofing structural steel.

The prior art includes many problems, including the difficulty of properly adjusting the traditional corner bead to the adjacent surface, the uneven application of fireproofing material, and the lack of a dam for the wet cement material. Despite these well-known and long-existing problems, and a readily apparent market for a solution, the prior art does not disclose or suggest a viable, cost-effective solution to the aforementioned problems of the prior art.

Accordingly, a need exists for an improved corner bead to avoid inaccuracy in gauging the thickness of the fireproofing material and to allow easy installation along three surfaces. An improved self-aligning double wire corner bead is inexpensive to manufacture and easy to install.

SUMMARY

The present invention provides a self-aligning, double wire corner bead that allows to make, in an accurate and quick manner, corners of a fireproofing material around structural steel members, said fireproofing material having uniform thickness around the structural steel member. This is accomplished by bending a single strip of welded wire fabric of pre-determined width along a plurality of longitudinally extending lines (axes) to provide a profile of a metal sheet having a plurality of dihedral angles, two wings of the desired width, a single wire membrane and a double wire membrane, said double wire membrane comprising a first leg and a second leg as substantially shown in FIGS. 4 and 5.

The angle at which each wing meets the single wire membrane and a second leg of the double wire membrane of the device, respectively, determines the thickness of the fireproofing material distributed around the structural steel member along three surfaces. Further, said thickness may be modified by changing the width of each respective wing. The uniformity in thickness of the fireproofing material distributed around three surfaces of the structural steel member is achieved by bending the first wing and the second wing at approximately the same angle in relation to the single wire membrane and the second leg of the double wire membrane, respectively. The uniformity in thickness of the fireproofing material distributed around all surfaces of the structural steel member in a contour type application is achieved by using the same width of the single metal strip bent to create an identical single metal sheet profile for all corners of the structural steel member.

It is further an object of the present invention to provide an improved corner bead for fireproofing structural steel without the need of adjusting the legs.

Another object of the present invention is to provide novel means of installing the corner bead by easier attachment to the structural steel.

Another object of the present invention is to provide an improved technique for application of accurate thickness of fireproofing material along three surfaces under any construction condition for making said fireproofing of structural steel members.

A further object of the present invention is to provide a dam to form a roughened surface on the first application of fireproofing material until it hardens along three surfaces.

While satisfying these and other related objectives, the present invention provides an improved, self-aligning, double wire corner bead for fireproofing structural steel which is very competitive from a mere economic standpoint. The corner bead of the present invention consists of a single strip of welded wire fabric cut to a desired width for the fireproofing thickness and bent along a plurality of longitudinal axes to form a set of wings, a single wire membrane, and a double wire membrane, said double wire membrane having a first leg and a second leg, said first leg seamlessly becoming said second leg through a process of bending of said double wire membrane such that said first leg is substantially parallel to said second leg, and wherein said single wire membrane and said double wire membrane are attached by the attachment means to the lath distributed around the structural steel member.

In accordance with the present invention, the corner bead includes a single elongated strip of welded wire fabric of pre-determined width, said single strip of welded wire fabric comprising a set of flexible mesh strips as shown in FIG. 3.

According to one embodiment of the present invention, the improved double wire corner bead allows each element of the bent wire mesh of the corner bead to perform different functions that are essential for the successful completion of the fireproofing process along three surfaces.

The single wire membrane and the double wire membrane provide a flat portion of a grid (mesh) through which pneumatic or screw type fasteners attach the mesh to the structural steel at the appropriate location. In addition, the double-wire membrane provides additional support for two wings positioned at the opposite corners of the steel structure member, hence facilitating one piece of wire mesh to cover two corners and three surfaces of the structure. This easy application establishes automatic alignment of the corner bead along three surfaces, eliminates the cumbersome process of shrinking or expanding the distance between the legs of the traditional bead, as well as provides only one strip of metal of the desired width to allow fireproofing of two corners of the steel structure member along three surfaces at the same time in a contour-method application of the fireproofing material.

The width of the set of wings and/or the angle at which the first and the second wing meet the single wire membrane and the second leg of the double wire membrane, respectively, determines the thickness of the fireproofing material distributed along three surfaces by providing a rigid screed edge along a nose. Therefore, the correct amount of fireproofing material is distributed adjacent to the corner bead creating a leveled application throughout the surface.

The width of the set of wings also provides a dam to form a roughened surface on the first application of the fireproofing material until the fireproofing material hardens. This forming action allows successive application of the cement material to the adjacent surface.

In another aspect, the present invention includes a method of manufacturing an improved self-aligning, double wire corner bead for fireproofing structural steel comprising a single strip of welded wire fabric cut to the desired width for the fireproofing thickness and bent along a plurality of longitudinally extending lines (axes) to form a profile of a metal sheet, a first longitudinal line to define a first wing and a single wire membrane extending laterally therefrom at a first angle of approximately greater than 90 degrees but less than approximately 180 degrees relative to each other and wherein said single wire membrane is secured to a structural steel member and said first wing is configured to establish a desired thickness of the fireproofing material along two surfaces by providing a rigid screed edge along the nose, a second longitudinal line to define said single wire membrane and a first leg of a double wire membrane extending from said single wire membrane in a continuous manner and at a second angle of approximately 90 degrees relative to each other, a third longitudinal line to define said first leg of said double wire membrane and a second leg of said double wire membrane such that said first leg is positioned substantially parallel to said second leg (the second leg substantially overlaps the first leg), and wherein said double wire membrane is secured to said structural steel member, and a fourth longitudinal line to define a second wing and said second leg of said double wire membrane, said second leg extending downwardly from said second wing at a third angle of approximately greater than 90 degrees but less than approximately 180 degrees relative to each other, and wherein said third angle is substantially equal to said first angle.

In a further aspect, the present invention includes a method of finishing a set of corners for cementitious fireproofing in a contour application of a set of structural steel members, the method comprising the steps of: selecting a corner bead comprising a single strip of welded wire fabric cut to the appropriate width for the fireproofing thickness and bent along a plurality of longitudinally extending lines, to provide a profile having a plurality of dihedral angles, wherein a first longitudinal line to define a first wing and a single wire membrane extending laterally therefrom at a first angle of approximately greater than 90 degrees but less than approximately 180 degrees relative to each other and wherein, said single wire membrane is secured to a structural steel member and a first wing is configured to establish a desired thickness of the fireproofing material along two surfaces by providing a rigid screed edge along the nose, a second longitudinal line to define said single wire membrane and a first leg of a double wire membrane extending from said single wire membrane in a continuous manner and at a second angle of approximately 90 degrees relative to each other, a third longitudinal line to define said first leg of said double wire membrane and a second leg of said double wire membrane such that said second leg is extending from said first leg of said double wire membrane in a continuous manner in such a way that said first leg is positioned substantially parallel to the second leg (the second leg substantially overlaps the first leg), and wherein said double wire membrane is secured to said structural steel member, and a fourth longitudinal line to define a second wing and said second leg of said double wire membrane, said second leg extending downwardly from said second wing at a third angle of approximately greater than 90 degrees but less than approximately 180 degrees relative to each other, and wherein said third angle is substantially equal to said first angle.

A dihedral angle (also called a face angle) is the internal angle at which two adjacent faces of each section member of the double wire corner bead is delimited by the two inner faces, e.g., angle $\alpha_1$ formed between adjacent faces of the first wing and the single wire membrane, angle $\alpha_2$ formed between adjacent faces of the second wing and the second leg of the double wire membrane and angle $\beta$ formed between adjacent faces of the single wire membrane and the first leg of the double wire membrane. The fourth angle created along the third longitudinal line between the first and the second leg of the double wire membrane is substantially zero (0) degrees so that the first leg and the second leg substantially overlap each other, and are approximately parallel, with respect to each other.

DETAILED DESCRIPTION

Figure 1:
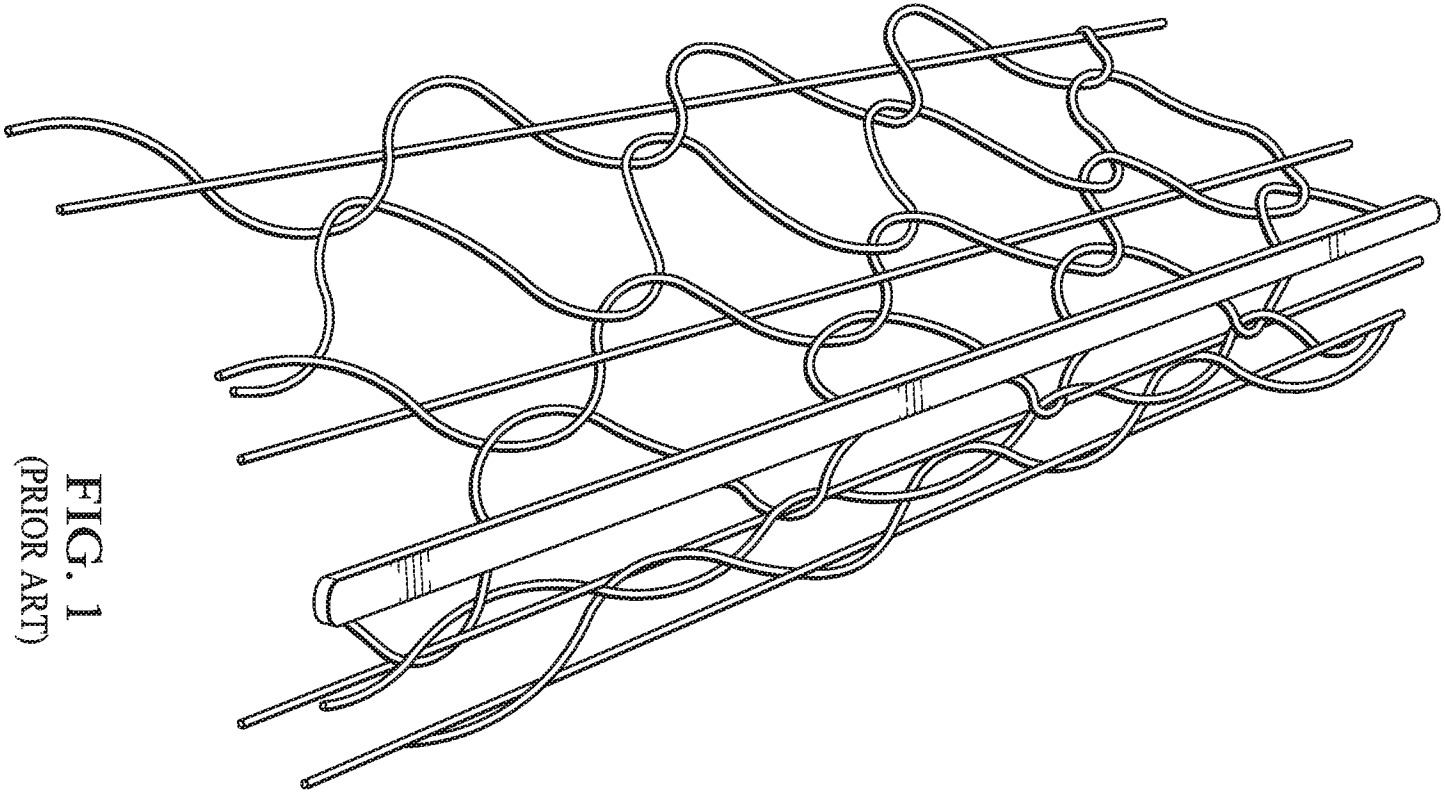
FIG. 1 (PRIOR ART)
FIG. 1 is a perspective view of a small section of a corner bead according to the prior art.
Figure 2:
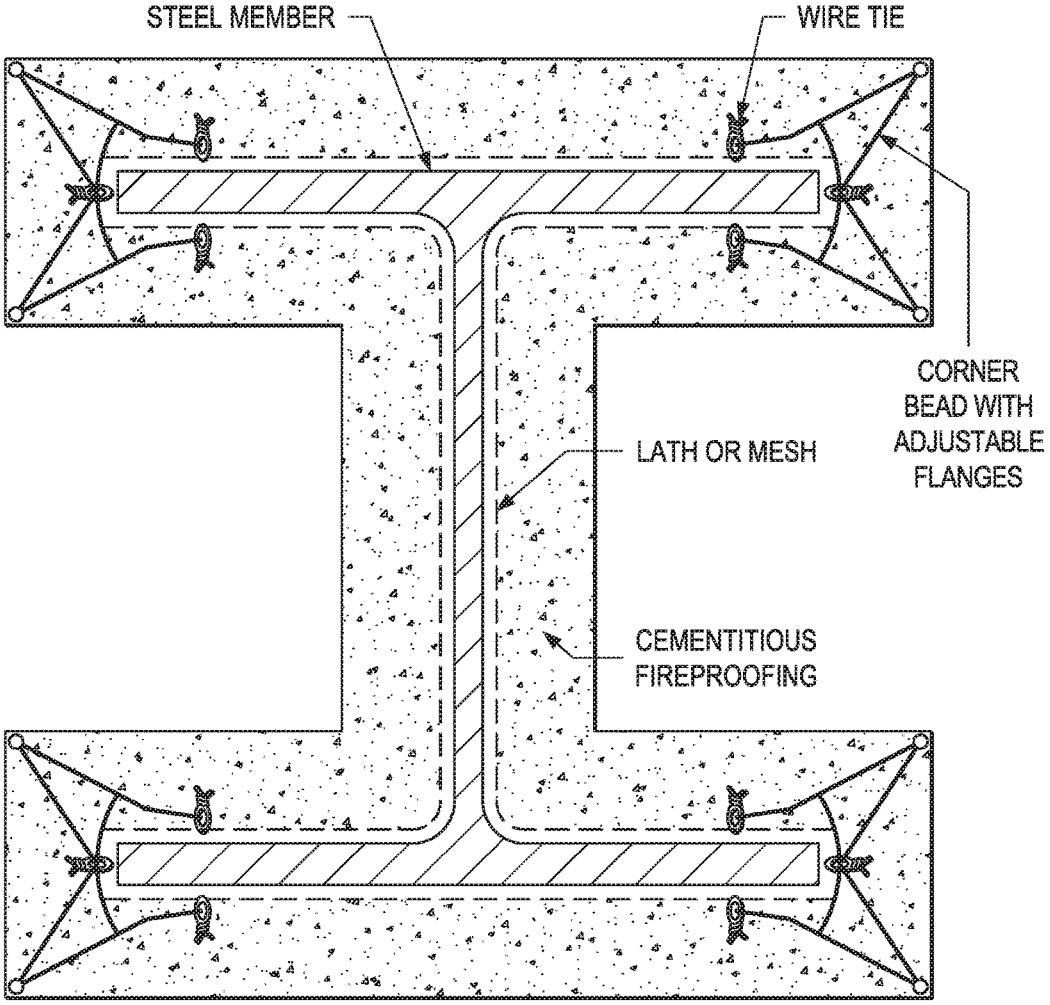
FIG. 2 (PRIOR ART)
FIG. 2 is a cross-sectional schematic view of a fireproofing structure utilizing a prior art corner bead installed according to a contour method.
Figure 3:
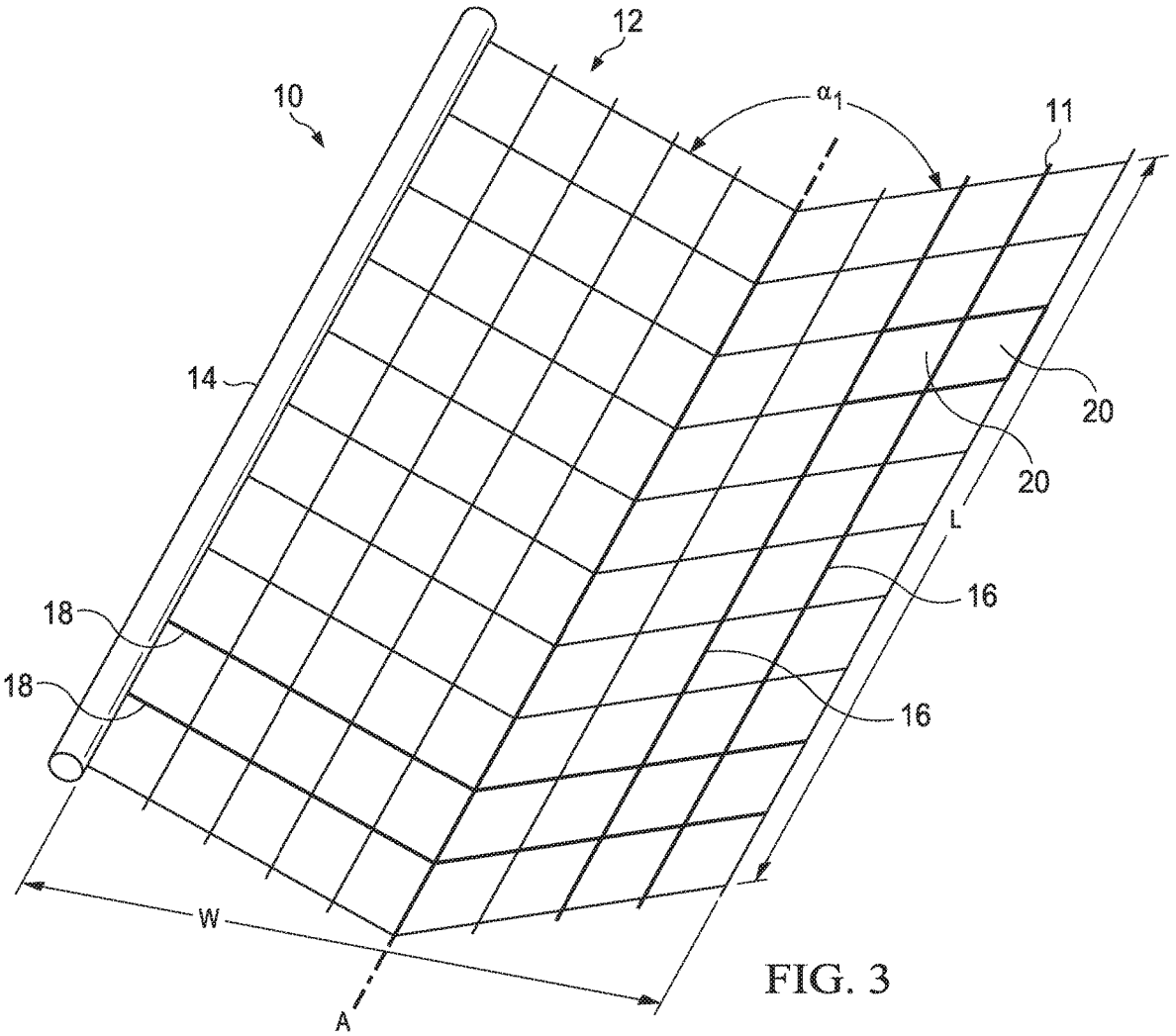
FIG. 3 is a perspective view of an exemplary small section of the corner bead of the present invention bent along a longitudinal axis and manufactured according to an embodiment of the present invention.

Referring to FIG. 3, corner bead 10 includes a plurality of longitudinal ribs 16 arranged substantially parallel with respect to a plurality of longitudinal axes, including longitudinal axis A and to each other, and a plurality of transverse ribs 18 distributed between and extending substantially perpendicular to the plurality of longitudinal axes and the plurality of longitudinal ribs 16. A set of void areas 20 is defined by the plurality of longitudinal ribs 16 and the plurality of transverse ribs 18, such that each void area 20 is bounded by at least two longitudinal ribs 16 and at least two transverse ribs 18. A section of corner bead 10 includes a single strip of welded wire fabric cut to a predetermined length L and a predetermined width W. The predetermined length L and the predetermined width W correspond to a predetermined fireproofing thickness.

In a preferred embodiment, corner bead 10 is made of a suitable metal, such as 16 gauge wire. Other suitable materials known in the art may be employed, including suitable plastics. In a preferred embodiment, corner bead 10 is a double welded wire fabric.

In a preferred embodiment, corner bead 10 has a set of bends integrally formed in corner bead 10 along the plurality of longitudinal axes. Any number of bends may be employed. Longitudinal axis A defines first wing 12 and single wire membrane 11. First wing 12 and single wire membrane 11 form angle $\alpha_1$ of approximately greater than 90 degrees, but less than approximately 180 degrees as further illustrated in FIGS. 4 and 5. A set of edges of first wing 12 defines a substrate to which nose 14 is attached. Nose 14, first wing 12, and second wing 12' (shown in FIG. 5) provide a rigid edge having a dam-like function, as will be further described below.

In a preferred embodiment, nose 14 is made of a suitable plastic, such as polyvinyl chloride. Other suitable materials known in the art may be employed.

Figure 4:
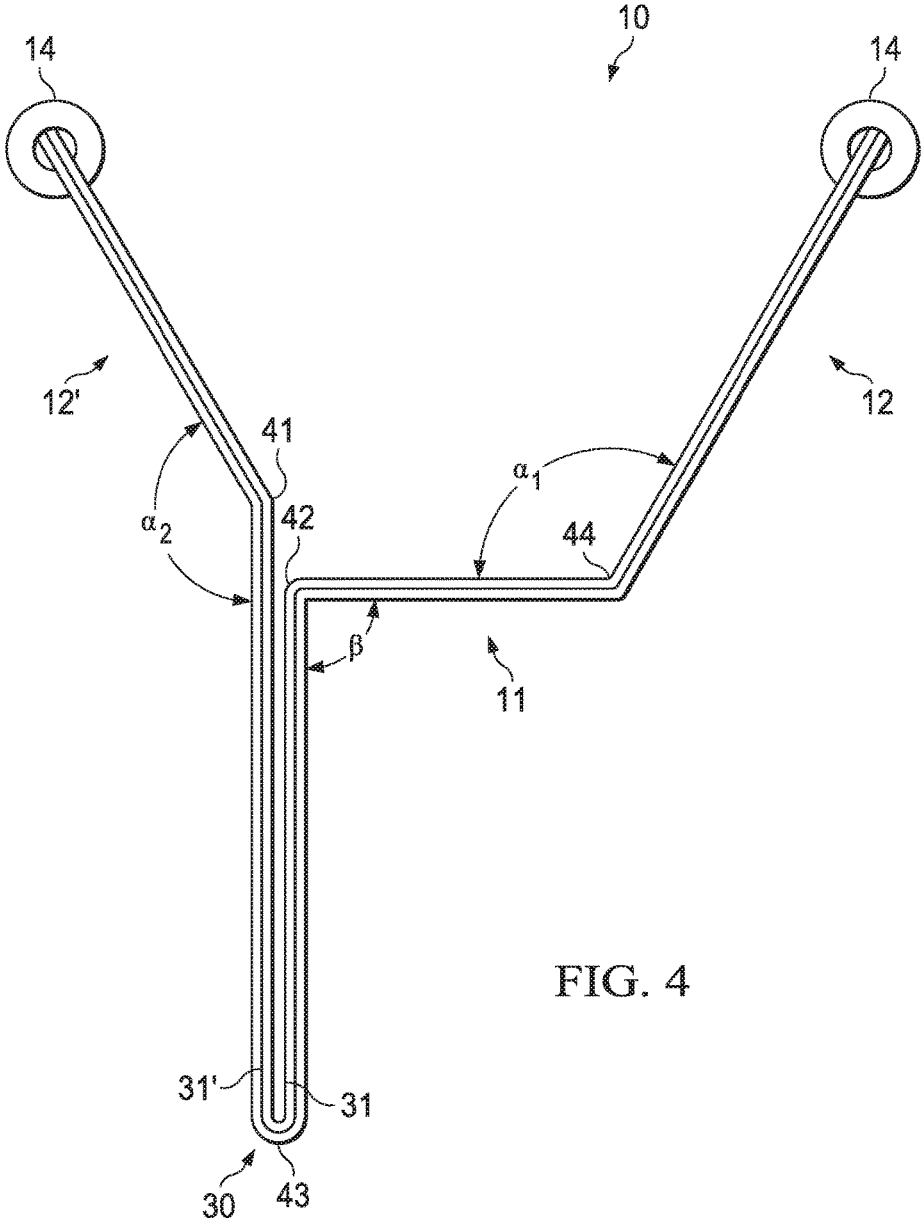
FIG. 4 is an enlarged cross-sectional schematic view of the self-aligning, double wire corner bead of the present invention.

Referring to FIG. 4, corner bead 10 is bent along a plurality of longitudinal lines 41, 42, 43, and 44, to provide a substantially continuous profile having a plurality of dihedral angles. Longitudinal line 44 defines first wing 12 and single wire membrane 11 extending laterally therefrom at angle $\alpha_1$. Angle $\alpha_1$ is approximately greater than 90 degrees, but less than approximately 180 degrees. Each of noses 14 is attached to first wing 12 and second wing 12'. Longitudinal line 42 defines single wire membrane 11 and leg 31 of double wire membrane 30 extending from single wire membrane 11 in a continuous manner. Single wire membrane 11 and leg 31 are separated by angle $\beta$. Angle $\beta$ is approximately 90 degrees. Longitudinal line 43 defines leg 31 of double wire membrane 30 and leg 31' of double wire membrane 30. Leg 31' is positioned substantially parallel to leg 31. Leg 31' substantially overlaps leg 31. Longitudinal line 41 defines second wing 12' and leg 31' of double wire membrane 30. Leg 31' extends away from second wing 12' at angle $\alpha_2$. Angle $\alpha_2$ is approximately greater than 90 degrees, but less than approximately 180 degrees.

Figure 5:
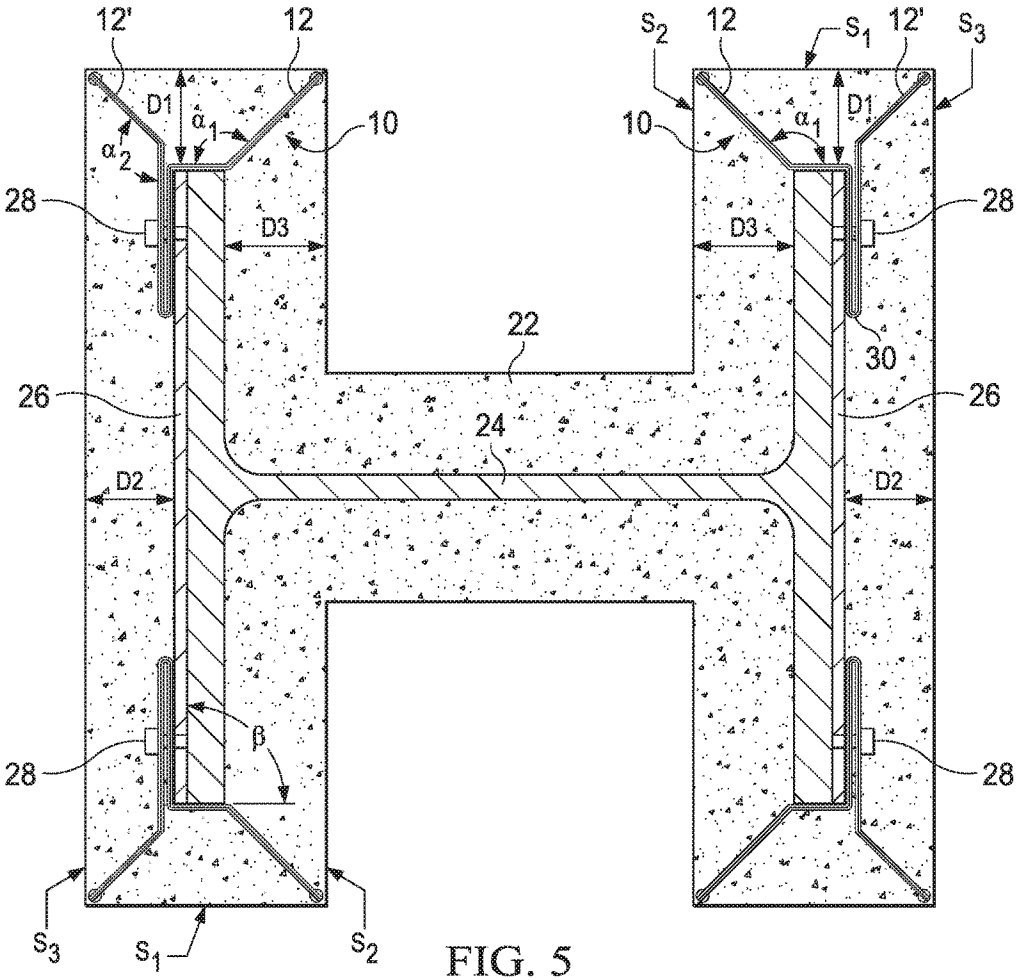
FIG. 5 is a cross-sectional schematic view of a fireproofing structure utilizing a self-aligning, double wire corner bead of the present invention according to the contour method.

In use, the improved, self-aligning, double wire corner bead 10 of the present disclosure is utilized in a contour-like manner, surrounding a structural steel member with fireproofing material. Referring to FIG. 5, single wire membrane 11 is secured to structural steel member 24. First wing 12 is configured to establish a desired thickness of fireproofing material 22 along two surfaces of the structural steel member by providing a rigid screed edge to which nose 14 is attached. Double wire membrane 30 is secured to structural steel member 24, as will be further described below. Fireproofing material 22 surrounds the dimensions of the structural steel member 24 in a contour-like manner, tracing structural steel member 24 in all dimensions. The single strip of corner bead 10 allows uniform distribution of fireproofing material 22 along three surfaces, surfaces $S_1$, $S_2$, and $S_3$.

Referring to FIGS. 4 and 5, the width of the wings 12 and 12' determines distances $D_1$, $D_2$, and $D_3$, and defines generally planar surfaces $S_1$, $S_2$, and $S_3$ forming a set of corners of fireproofing material 22 distributed around structural steel member 24. Similarly, any of distances $D_1$, $D_2$, and $D_3$ are optionally altered by changing angles $\alpha_1$ and $\alpha_2$. Angles $\alpha_1$ and $\alpha_2$ are substantially equal and measure approximately greater than 90 degrees, but less than 180 degrees. Angle $\beta$ measures approximately 90 degrees. For example, the smaller (less obtuse) angle $\alpha_1$ is between first wing 12 and the single wire membrane 11 the longer distance $D_1$ is between lath 26 and surface $S_1$, and the shorter distance $D_3$ is between lath 26 and surface $S_2$. Similarly, the less obtuse angle $\alpha_2$ is between second wing 12' and leg 31' of double wire membrane 30, the longer distance $D_2$ is and the shorter distance $D_1$ is making distributed fireproofing material 22 thicker along surface $S_3$ in relation to a thinner strip of fireproofing material 22 along surface $S_1$.

In a preferred embodiment, the determination of angles $\alpha_1$ and $\alpha_2$ should be such that a uniform thickness of fireproofing material 22 along surface $S_1$ is achieved.

In one embodiment, lath 26 is distributed around structural steel member 24. Single wire membrane 11 is attached through lath 26 into structural steel member 24 by pneumatic fastener 28 at a single fastening position on single wire membrane 11. Other joining or attaching means known in the art, such as welded pins or screws, may be employed.

In another embodiment, each of single wire membrane 11 and double wire membrane 30 is attached to structural steel member 24 by pneumatic fastener 28 at a single fastening position on double wire membrane 30.

In another embodiment, leg 31 and leg 31' of double wire membrane 30 are attached through lath 26 into structural steel member 24 by pneumatic fastener 28 at a single fastening position on double wire membrane 30. Other joining or attaching means known in the art, such as welded pins or screws, may be employed. According to one embodiment of the present invention, lath 26 is optionally distributed along the entire perimeter of structural steel member 24 to be fireproofed (not shown). In another embodiment, lath 26 is distributed along a portion of the perimeter of structural steel member 24.

In other embodiments, any number of fastening positions and locations may be employed.

The width of first wing 12 and second wing 12' along with nose 14 attached to the outer edges of both wings serves as a dam during the process of fireproofing. Fireproofing material 22 is then sprayed onto lath 26 and screened off using the location of nose 14 to determine the finished thickness of fireproofing material 22.

Referring to FIG. 5, in a shop application, i.e., fireproofing material 22 is applied to structural steel member 24 in a pre-fabrication facility, the cementitious composition is sprayed or poured one layer at a time on a surface of lath 26 positioned horizontally. Structural steel member 24 is then rotated 90 degrees and the adjacent surfaces are positioned horizontally to allow easy application of fireproofing material 22. With this process in place, each successive spraying is performed which allows hardening of fireproofing material 22 before the next rotation of structural steel member 24. As can be seen, the dam-like functionality of corner bead 10 according to one embodiment of the present invention is critical as it provides an appropriate keying surface to bond the subsequent layers of fireproofing material 22. Each structural steel member 24 is turned to uniformly apply the cementitious material to all surfaces.

It will be appreciated by those skilled in the art that any type of member may be employed.

In a field application on a job site, structural steel members 24 are erected into a structure prior to fireproofing, and all surfaces of structural steel member 24 may be sprayed or troweled onto the surface of lath 26 at the same time (not shown).

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or greater than one instance, requires at least the stated number of instances of the element, but is not intended to exclude from the scope of the claim a structure or method having more instances of that element than stated. The word "comprise" or a derivative thereof, when used in a claim, is used in a nonexclusive sense that is not intended to exclude the presence of other elements or steps in acclaimed structure or method.

The invention claimed is:

1. A method for fireproofing a member comprising a set of surfaces, with a fireproofing material, the method comprising the steps of:

attaching a corner bead to a subset of the set of surfaces, the corner bead comprising:

a welded wire fabric;

a set of bends integrally formed in the welded wire fabric;

a first wing defined by the set of bends;

a single wire membrane defined by the set of bends, adjacent to the first wing;

a double wire membrane defined by the set of bends, adjacent to the single wire membrane;

a second wing defined by the set of bends, adjacent to the double wire membrane;

a plurality of generally planar surfaces defined by the first wing and the second wing; and, the welded wire fabric only fastened to the member at a fastening position on the double wire membrane;

a first angle between the first wing and the single wire membrane;

a second angle between the single wire membrane and the double wire membrane;

a third angle between the double wire membrane and the second wing;

determining a thickness of the fireproofing material based on the first angle; and, applying the fireproofing material to the member and the corner bead according the thickness.

2. The method of claim 1, wherein the step of determining a thickness of the fireproofing material based on the first angle further comprises the step of adjusting the first angle.

3. The method of claim 1, further comprising the steps of:

positioning a set of lath between the corner bead and the subset of the set of surfaces; and, attaching the corner bead to the subset of the set of surfaces through the set of lath.

4. A method for fireproofing a member comprising a set of surfaces, with a fireproofing material, the method comprising the steps of:

attaching a corner bead to a subset of the set of surfaces, the corner bead comprising:

a welded wire fabric;

a set of bends integrally formed in the welded wire fabric;

a first wing defined by the set of bends;

a single wire membrane defined by the set of bends, adjacent to the first wing;

a double wire membrane defined by the set of bends, adjacent to the single wire membrane;

a second wing defined by the set of bends, adjacent to the double wire membrane;

a plurality of generally planar surfaces defined by the first wing and the second wing; and, the welded wire fabric only fastened to the member at a fastening position on the double wire membrane;

a first angle between the first wing and the single wire membrane;

a second angle between the single wire membrane and the double wire membrane;

a third angle between the double wire membrane and the second wing;

determining a thickness of the fireproofing material based on the third angle; and, applying the fireproofing material to the member and the corner bead according the thickness.

5. The method of claim 4, wherein the step of determining a thickness of the fireproofing material based on the third angle further comprises the step of adjusting the third angle.

6. The method of claim 4, further comprising the steps of:

positioning a set of lath between the corner bead and the subset of the set of surfaces; and, attaching the corner bead to the subset of the set of surfaces through the set of lath.

7. A method for fireproofing a member comprising a set of surfaces, with a fireproofing material, the method comprising the steps of:

attaching a corner bead to a subset of the set of surfaces, the corner bead comprising:

a welded wire fabric;

a set of bends integrally formed in the welded wire fabric;

a first wing defined by the set of bends;

a single wire membrane defined by the set of bends, adjacent to the first wing;

a double wire membrane defined by the set of bends, adjacent to the single wire membrane;

a second wing defined by the set of bends, adjacent to the double wire membrane;

a plurality of generally planar surfaces defined by the first wing and the second wing; and, the welded wire fabric only fastened to the member at a fastening position on the double wire membrane;

a first angle between the first wing and the single wire membrane;

a second angle between the single wire membrane and the double wire membrane;

a third angle between the double wire membrane and the second wing;

determining a thickness of the fireproofing material based on the first angle and the third angle; and, applying the fireproofing material to the member and the corner bead according the thickness.

8. The method of claim 7, wherein the step of determining a thickness of the fireproofing material based on the first angle and the third angle further comprises the step of adjusting the first angle.

9. The method of claim 7, wherein the step of determining a thickness of the fireproofing material based on the first angle and the third angle further comprises the step of adjusting the third angle.

10. The method of claim 7, wherein the step of determining a thickness of the fireproofing material based on the first angle and the third angle further comprises the steps of:

adjusting the first angle; and, adjusting the third angle.

11. The method of claim 7, further comprising the steps of:

positioning a set of lath between the corner bead and the subset of the set of surfaces; and, attaching the corner bead to the subset of the set of surfaces through the set of lath.

* * * * *